US006682159B2

(12) United States Patent
Compagnucci

(10) Patent No.: US 6,682,159 B2
(45) Date of Patent: Jan. 27, 2004

(54) EXTRACTABLE RACK FOR CABINETS EQUIPPED WITH PROTECTION BEARING COVER FOR SLIDE GUIDES

(75) Inventor: Rossano Compagnucci, Santa Maria Nuova (IT)

(73) Assignee: Compagnucci - S.p.A., Santa Maria Nuova (IT)

( * ) Notice: Subject to any disclaimer, the term of this patent is extended or adjusted under 35 U.S.C. 154(b) by 0 days.

(21) Appl. No.: 10/106,137

(22) Filed: Mar. 25, 2002

(65) Prior Publication Data

US 2002/0140329 A1 Oct. 3, 2002

(30) Foreign Application Priority Data

Mar. 29, 2001 (IT) ..... MC20010017 U

(51) Int. Cl.[7] ..... A47B 88/04
(52) U.S. Cl. ..... 312/334.24
(58) Field of Search ..... 312/330.1, 334.24, 312/334.25, 334.28, 334.26, 311, 334.31, 334.34, 350, 302, 301, 334.23, 334.27

(56) References Cited

U.S. PATENT DOCUMENTS

| | | | | | |
|---|---|---|---|---|---|
| 600,742 | A | * | 3/1898 | Porter | 312/334.24 X |
| 3,874,758 | A | * | 4/1975 | Greene | 312/334.24 X |
| 5,625,969 | A | * | 5/1997 | Vogler | 40/611 |
| 5,992,956 | A | * | 11/1999 | Slivon | 312/334.28 X |
| 6,199,966 | B1 | * | 3/2001 | Fulterer | 312/330.1 X |

FOREIGN PATENT DOCUMENTS

| | | | | |
|---|---|---|---|---|
| FR | 2226959 | * | 11/1974 | 312/334.24 |

* cited by examiner

*Primary Examiner*—James O. Hansen
(74) *Attorney, Agent, or Firm*—Armstrong, Kratz, Quintos, Hanson & Brooks, LLP

(57) ABSTRACT

The present invention relates to an extractable rack for cabinets that comprises a bearing frame formed by two uprights connected on the bottom and on the top by two covers that can hide and protect the slide guides of the rack.

3 Claims, 2 Drawing Sheets

EXTRACTABLE RACK FOR CABINETS EQUIPPED WITH PROTECTION BEARING COVER FOR SLIDE GUIDES

BACKGROUND OF THE INVENTION

The present patent application relates to an extractable rack for cabinets, of the type commonly used in modern modular kitchens, that supports a series of shelves or baskets used to store different types of foods.

This type of racks usually consists in a bearing frame formed by two uprights connected by two crosspieces, one on the bottom and one on the top, thus forming a rectangular frame that is inserted in a cabinet with same height edgeways, that is oriented on an intermediate vertical plane parallel to the sides of the cabinet.

The two uprights are provided with means, such as hooks or brackets, used to anchor multiple shelves or baskets that protrude on one or two sides of the bearing frame.

To facilitate loading and unloading, the majority of the racks are of extractable type so that, after opening the cabinet door, the user can extract them from their housing to access the protruding shelves or baskets from both sides.

The racks can be extracted thanks to the fact that they are coupled with two slide guides mounted inside the upper and lower wall of the cabinet.

The slide guides have an ordinary telescopic structure and are formed by a bearing guide screwed onto the cabinet and a sliding counter-guide, on which the lower crosspiece and the upper crosspiece of the bearing frame of the rack are screwed.

Currently, the slide guides are not protected with a screen. For this reason they often contain dust, grease and dirt in general that reduces their sliding capacity or obstructs the extraction of the rack.

On the other hand, being installed on the bottom and on the roof of the cabinet and having a telescopic structure, the slide guides are not easy to clean.

SUMMARY OF THE INVENTION

The purpose of the invention is to find a solution to this inconvenience by realising a rack in which the slide guides are hidden by a protection cover.

Another purpose of the invention is to avoid the costs borne to buy and install an ordinary protection cover, by realising a rack in which the covers are an integral part of the bearing frame of the rack.

Finally, another purpose of the invention is to improve the aesthetics of extractable racks for cabinets, by realising a new model of rack in which the slide guides are not visible, thanks to the presence of suitable protection covers that are an integral part of the bearing frame of the rack.

The model of the invention consists in an extractable rack for cabinets, whose bearing frame is formed by two uprights connected on the bottom and on the top by two identical covers made of thick resistant box-shaped plate that hide and protect the slide guides of the rack.

BRIEF DESCRIPTION OF THE DRAWINGS

For major clarity the description of the extractable rack of the invention continues with reference to the enclosed drawings, which are intended for purposes of illustration and not in a limiting sense, whereby.

DETAILED DESCRIPTION OF THE PREFERRED EMBODIMENT

Figure 1:
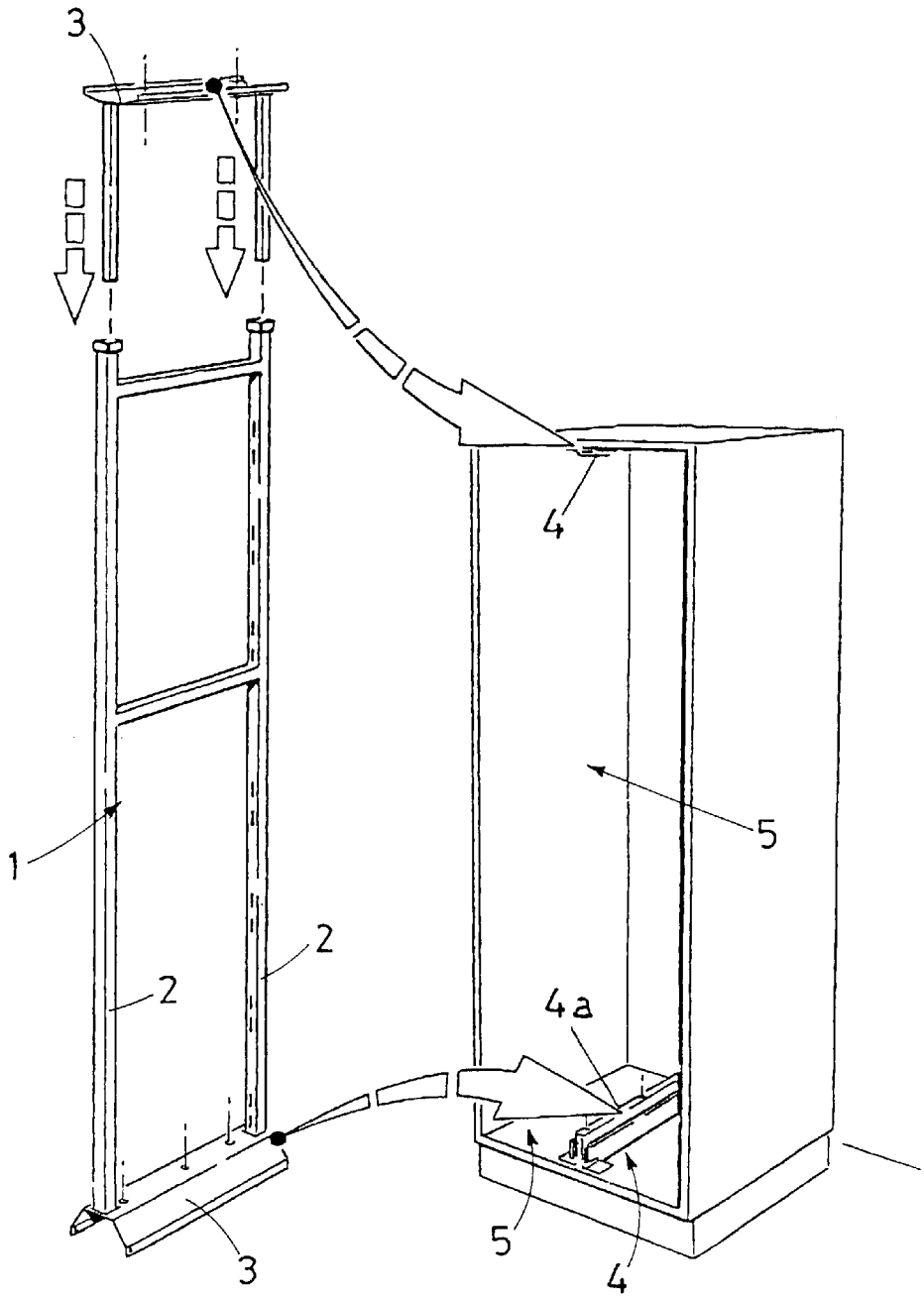
FIG. 1 is a schematic perspective view of the rack of the invention and the cabinet in which the same is installed.

With reference to the aforementioned figures, the extractable rack (1) of the invention comprises a bearing frame formed by two uprights (2) connected on the top and on the bottom by two covers (3) made with thick resistant box-shaped plate that hide and protect the slide guides (4) of the rack (1), previously mounted on the bottom and on the roof of the cabinet (5).

In the preferred embodiment of the invention shown in the enclosed figures, the uprights (2) have a telescopic structure so that their height, and consequently the height of the rack (1), can vary and be adjusted from time to time according to the distance between the slide guides (4) fixed on the bottom and on the roof of the cabinet (5).

Figure 3:
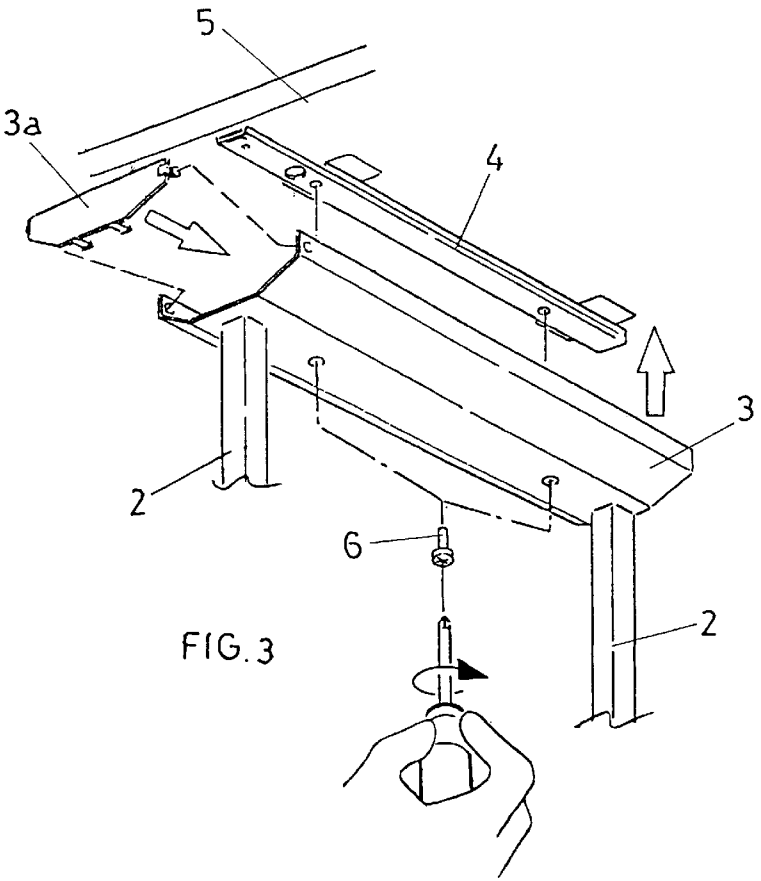
FIGS. 2 and 3 show the assembling of the rack of the invention in a cabinet that has been previously equipped with slide guides on the bottom and on the roof.
Figure 2:
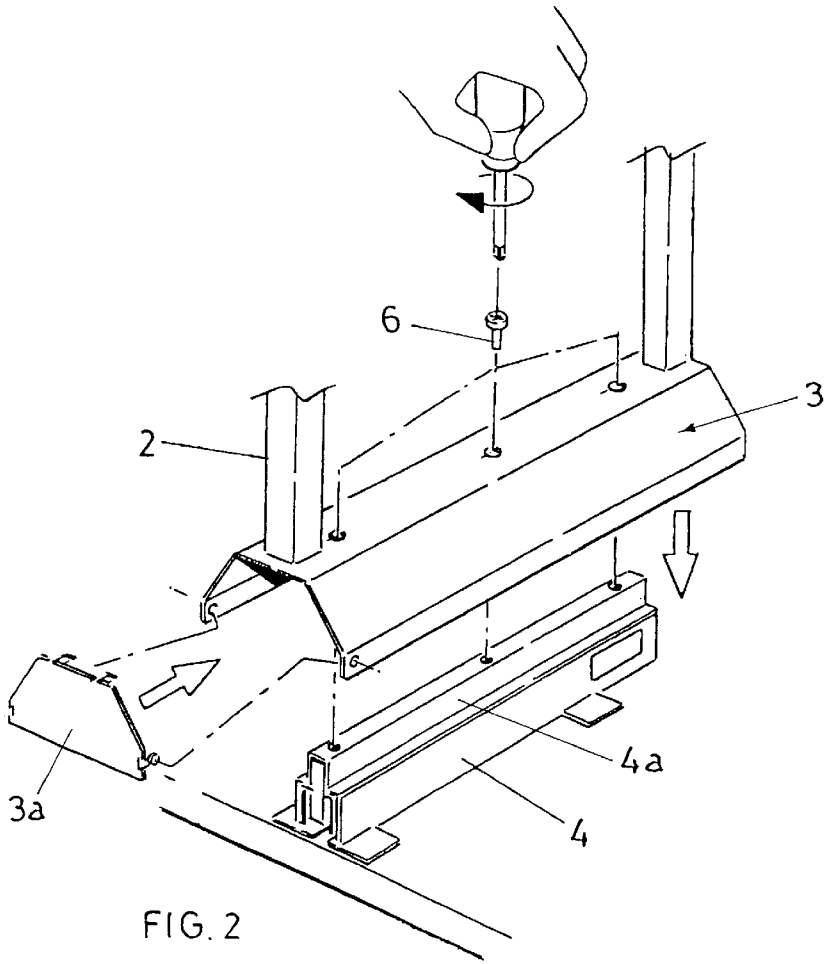

As shown in FIGS. 2 and 3, the covers (3) act as bearing elements, being directly fastened to the sliding counter-guide **(4*a*) of the slide guides (4) with screws (6)**.

In other words, the bearing frame of the rack (1) is connected to the slide guides (4) by means of the covers (3), which act as bearing elements in the frame and at the same time as protection elements of the slide guides (4).

The covers (3) are frontally closed with lids **(3*a*)**.

What is claimed is:

1. Extractable rack for a cabinet having a roof and a bottom, a first telescoping slide guide (4) having a first sliding counter guide **(4*a*) mounted on the roof and a second slide guide (4) having a second telescoping sliding counter guide (4*a*) mounted on the bottom of the cabinet characterised by the fact that the rack comprises a bearing frame formed by two uprights (2) each upright having a top and a bottom, the tops of the uprights being connected by a first cover (3) fixed to the first sliding counter guide (4*a*), the bottoms of the uprights being connected by a second cover (3) fixed to the second sliding counter guide, each cover made with thick and resistant plate formed in the shape of a box and provided with holes for the passage of screws (6) used to fasten the respective covers (3) to the first sliding counter guide (4*a*) and to the second sliding, wherein the covers (3)** act as bearing elements and protection elements.

2. Rack according to claim 1, characterised by the fact that the uprights (2) have a telescopic structure.

3. Extractable rack for a cabinet having a roof and a bottom, a first slide guide (4) having a first sliding counter guide **(4*a*) mounted on the roof and a second slide guide (4) having a second sliding counter guide (4*a*) mounted on the bottom of the cabinet characterised by the fact that the rack comprises a bearing frame formed by two uprights (2), each upright having a top and a bottom, the tops of the uprights being connected by first cover (3), the bottoms of the uprights being connected by a second cover (3), each cover made with thick and resistant plate formed in the shape of a box and provided with holes for the passage of screws (6) used to fasten the respective covers (3) to the first sliding counter guide (4*a*) and to the second sliding counter guide (4*a*), wherein the covers (3) act as bearing elements and protection elements characterised by the fact that the covers (3) are frontally closed with lids (3*a*)**.

* * * * *